US006014126A

United States Patent [19]

Nishihara

[11] Patent Number: 6,014,126

[45] **Date of Patent: *Jan. 11, 2000**

[54] ELECTRONIC EQUIPMENT AND LIQUID CRYSTAL DISPLAY

[75] Inventor: Yasutomo Nishihara, Nara, Japan

[73] Assignee: Sharp Kabushiki Kaisha, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/515,974

[22] Filed: Aug. 16, 1995

[30] Foreign Application Priority Data

| | | | |
|---|---|---|---|
| Sep. 19, 1994 | [JP] | Japan | 6-223727 |
| Nov. 25, 1994 | [JP] | Japan | 6-291646 |
| Mar. 10, 1995 | [JP] | Japan | 7-051529 |

[51] Int. Cl.[7] ..... G09G 5/00

[52] U.S. Cl. ..... 345/132; 345/3; 345/507; 348/441

[58] Field of Search ..... 345/1–3, 132, 345/10, 11, 87, 185, 187, 201, 501, 507, 508, 511; 348/441, 443, 444, 445

[56] References Cited

U.S. PATENT DOCUMENTS

| | | | |
|---|---|---|---|
| 3,751,581 | 8/1973 | Sakata et al. | 348/441 |
| 4,855,728 | 8/1989 | Mano et al. | 345/3 |
| 5,138,305 | 8/1992 | Tomiyasu | 345/3 |
| 5,155,478 | 10/1992 | Sekiya et al. | 345/147 |
| 5,172,107 | 12/1992 | Kanno et al. | 345/100 |
| 5,218,274 | 6/1993 | Zenda | 345/3 |
| 5,327,235 | 7/1994 | Richards | 348/441 |
| 5,508,714 | 4/1996 | Zenda | 345/3 |
| 5,534,883 | 7/1996 | Koh | 345/89 |

FOREIGN PATENT DOCUMENTS

| | | | |
|---|---|---|---|
| 0384442 | 8/1990 | European Pat. Off. | 345/3 |
| 03007987 | 1/1991 | Japan | 345/3 |
| 5-307370 | 11/1993 | Japan . | |
| 6-67626 | 3/1994 | Japan . | |

OTHER PUBLICATIONS

Taynai, "Color Flat Panel Interface Guide", Cirrus Logic 1991, CL–GD6340 Application Note, Aug. 1991.

*Primary Examiner*—Lun-Yi Lao
*Attorney, Agent, or Firm*—Nixon & Vanderhye P.C.

[57] ABSTRACT

Electronic equipment comprising a display controller for outputting display data of a first frame frequency, and a frequency converting circuit for converting the display data of the first frame frequency to output display data of a second frame frequency which is higher than the first frame frequency and a non-integral multiple of the first frame frequency. Accordingly, the second frequency can be approximated to a frequency such that enables a high-frequency driven display device to render the optimal display characteristics, thereby enabling a display of high-quality image by eliminating the ghost and flicker on the screen.

12 Claims, 18 Drawing Sheets

ELECTRONIC EQUIPMENT AND LIQUID CRYSTAL DISPLAY

FIELD OF THE INVENTION

The present invention relates to electronic equipment and a liquid crystal display device employing a direct matrix type liquid crystal panel both capable of outputting various display data of different frame frequencies.

BACKGROUND OF THE INVENTION

Electronic equipment furnished with a display device comprises, as shown in FIG. 9, a CPU (central processing unit) 51, a RAM (random access memory) 53 connected to a bus 52 extending from the CPU 51, an I/O (input/output interface) 54, and a display controller 55. A VRAM (Video RAM) 56 and a display device 60 are connected to the display controller 55, so that display data stored in the VRAM 56 are sent to the display device 60 to be displayed.

When the display device 60, for example, a 240-line direct matrix type liquid crystal display device, is driven line-sequentially by the average voltage driving method, one selected pulse and 239 non-selected pulses are applied to each liquid crystal element in one frame period, meaning that the non-selected pulses are applied to the liquid crystal element far longer than the selected pulse.

Thus, liquid crystal molecules forming the liquid crystal element respond not only to the selected pulse but also to the non-selected pulses, which is known as a frame response phenomenon. The frame response phenomenon is conspicuous when the liquid crystal element is made of a liquid crystal material with a relatively quick response, and the contrast degrades as a result. In case of a multi-level display using a level control circuit of a skipping method, the number of colors available for a color display increases; however, at the same time, there occur inconveniences such as contrast degradation and flickers on the screen.

As shown in FIG. 11, the higher the frame frequency, the better the contrast. This is because the frame cycle becomes shorter as the frame frequency rises, and the frame response phenomenon does not easily occur in a short frame cycle. In case of the multi-level display using the skipping method, a good image can be displayed on the screen with reduced flickers by raising the frame frequency as set forth in Table 1 below. In Table 1, the flickers are reduced more in the order of marks XΔo.

TABLE 1

| FREQUENCY (Hz) | 60 | 120 | 180 | 240 | 300 |
|---|---|---|---|---|---|
| FLICKERS | X | Δ | ○ | ○ | ○ |

When a low-frequency driven display device and a high-frequency driven display device are connected to the above electronic equipment to display images simultaneously, the display quality of the latter degrades significantly due to the frame response phenomenon if the latter is timed to the former.

To eliminate this deficiency, a frame memory 57 is conventionally provided besides the VRAM 56 as shown in FIG. 12. To be more specific, the display controller 55 accesses the VRAM 56 by an original clock, while it accesses the frame memory 57 on a second clock generated by a clock divider 58, which is in sync with the original clock and has a frequency of an integral multiple of that of the original clock. Thus, a resulting display signal will have a second frame frequency which is an integral multiple of the original frame frequency. For example, when the original frame frequency is 60 Hz, then the second frame frequency is either 120 Hz, 180 Hz, 240 Hz, or 300 Hz, . . . .

Accordingly, the low-frequency driven display device displays an image at the original frame frequency, whereas the high-frequency driven display device displays an image at the second frame frequency which is an integral multiple of the original frame frequency. As a result, the frame response phenomenon occurring in the high-frequency driven display device can be eliminated.

However, according to the above structure, the second frame frequency is not a frame frequency such that enables the high-frequency driven display device to render the optimal display characteristics in most of the cases, thereby presenting a problem that ghosts or flickers appear on the screen.

Also, Japanese Laid-open Patent Application No. 6-67626/1994 discloses a structure as shown in FIG. 10: the frame frequency of an image signal S10 sent to a direct matrix type liquid crystal display device 62 from electronic equipment 61 on a host side is set to 80 Hz or more, so that the display quality is upgraded by reducing the frame response phenomenon. Thus, using this structure enables a high-contrast image display.

However, according to the above structure, the electronic equipment 61 on the host side must operate at a high-speed to output the image signal S10 of a high frame frequency to the liquid crystal display device 62. For this reason, the above structure demands high-speed memories and devices, which increases the manufacturing cost significantly. In addition, if the electronic equipment 61 on the host side is accelerated, it can not be driven at the same frame frequency driving a CRT (cathode ray tube) display device, the active matrix type liquid crystal display device or the like, thereby making it impossible to share the electronic equipment 61.

Further, there have been proposed some methods to drive the liquid crystal panel of a direct matrix type liquid crystal display device at a lower duty ratio, in which the screen of the liquid crystal panel (hereinafter referred to as the LCD) 41 is split into an upper half screen and a lower half screen to upgrade the display quality as shown in FIG. 14 accompanying with the present invention.

A first method is applied to a personal computer or the like, in which, as shown in FIG. 17, an LCD controller 68 interconnecting an LCD 65 and two VRAMs (video RAMS) each respectively serving as an upper half screen memory 66 and a lower half screen memory 67 is developed, so that the data for the upper half screen and lower half screen are outputted to the LCD 65 simultaneously from the upper half screen memory 66 and lower half screen memory 67, respectively.

A second method provides a driving device including a frame buffer memory for a liquid crystal display as is disclosed, for example, in Japanese Laid-open Patent Application No. 5-307370/1993.

More precisely, in the above driving device, an upper half screen block 71 and a lower half screen block 72, each storing their respective frame data and jointly forming a VRAM serving as a frame memory, are directly connected to an unillustrated driving driver of an LCD 70 as shown in FIG. 18. Also, a display controller 73 is connected to the upper half screen block 71 and lower half screen block 72. The display controller 73 outputs an address signal to access the upper half screen block 71 and lower half screen block 72, and a control signal to control the output of the display data to the LCD 70 from the upper half screen block 71 and lower half screen block 72.

This means that the electronic equipment on the host side outputs the display data without acknowledging whether the display data are to be stored in the upper half screen block 71 or lower half screen block 72 in the VRAM, but the display controller 73 must distinguish whether the display data are the data for the upper half screen or lower half screen to write the display data adequately into the upper half screen block 71 and lower half screen block 72 in the VRAM.

This is the reason why an address converting circuit 74 is provided to the conventional driving device. The address converting circuit 74 receives an address from the host to check whether the destination address of the display data from the host is in the upper half block 71 or lower half block 72, so that the display controller 73 accesses the upper half screen block 71 or lower half screen block 72 adequately to store the display data. If the address is in the upper half block 71, the address converting circuit 74 outputs the same intact; otherwise, it calculates a balance between the last address in the upper half screen block 71 and the leading address in the lower half screen block 72 in the VRAM, and adds the balance to the original address to output the adding result to the display controller 73.

According to this driving method, by providing the address converting circuit 74 before the conventional display controller 73, the host can access the VRAM in the same manner as the conventional method while the display data can be outputted sequentially to the upper half screen and lower half screen of the liquid crystal display device at the same timing.

However, according to the first method in which the LCD controller 68 is developed, it is necessary to design a complicated circuit and timing, thereby presenting a problem that it takes quite a long time and considerable efforts to develop the LCD controller 68.

More precisely, a dynamic RAM is used as a VRAM for a personal computer, whereas a dual port RAM is used as the VRAM for a workstation due to the need for a fast and accurate display. In case of the VRAM using the dynamic RAM, it is relatively easy to design the circuit and timing of the display controller, whereas in case of the VRAM using the dual port RAMs, or namely, the upper half screen memory 66 and lower half screen memory 67, it is not easy to design the circuit and timing of the display controller, or namely, the LCD controller 68, due to an increase in complexity.

In addition, manufacturing the LCD controller 68 costs much if the concerned electric equipment is in less demand, and makes the resulting electronic equipment expensive. Further, a software program for display must be developed separately for the LCD controller 68.

There is also a problem in the second method in which the frame memory is employed and the address converting circuit 74 is placed before the display controller 73. That is, since the circuit structure of the address converting circuit 74 is complicated and an unillustrated display device controller must be re-designed, the display device controller can not be shared with the other display devices.

Further, since the display data for the upper half and lower half screens are stored separately in the frame memory by converting the addresses, the circuit and interface or the like are undesireably upsized, which makes it almost impossible to place the resulting circuit on an LCD module.

SUMMARY OF THE INVENTION

Accordingly, the present invention has a first object to provide electronic equipment capable of displaying a high-quality image by converting a frame frequency into a frequency such that enables a display device to render the optimal characteristics To fulfill the first object, electronic equipment in accordance with one aspect of the present invention includes:

an interface unit for outputting display data of a first frame frequency; and frequency converting means, connected to the interface unit, for converting the display data of the first frame frequency to output display data of a second frame frequency, the second frame frequency being higher than the first frequency and a non-integral multiple of the first frequency.

According to the above structure, the electronic equipment includes the frequency converting means which converts the display data of the first frame frequency and outputs display data of the second frame frequency which is higher than the first frequency and a non-integral multiple of the first frequency. Thus, the second frame frequency can be approximated to a frequency such that enables a display device driven by a high frequency, such as a direct matrix type liquid crystal display, to render the optimal display characteristics, thereby enabling a display of a high-quality image by eliminating the ghosts or flickers.

Also, the present invention has a second object to provide a liquid crystal display capable of displaying a high-quality image without accelerating the electronic equipment by converting a frame frequency into a higher frame frequency.

To fulfill the second object, a liquid crystal display device in accordance with another aspect of the present invention includes frequency converting means for converting input display data of a first frame frequency from electronic equipment on a host side into display data of a second frame frequency which is higher than the first frame frequency.

According to the above structure, the frequency converting means converts the display data of the first frame frequency inputted from the electronic equipment on the host side into the display data of the second frequency which is higher than the first frequency, and the direct matrix type liquid crystal display is driven by the display data of the second frame frequency generated as the result of conversion. In other words, an image signal of a high frame frequency can be made on the side of the liquid crystal display without accelerating the electronic equipment on the host side.

Accordingly, a high-contrast image can be displayed without increasing the costs of the electronic equipment on the host side. In particular, a high-contrast image can be displayed with reduced flickers when it is displayed in multi-level using the skipping method. In addition, since the electronic equipment on the host side is not accelerated, the electronic equipment can be shared with a conventional CRT display device, active matrix type display device or the like.

Further, the present invention has a third object to provide a liquid crystal display device which facilitates the driving of the split screens without demanding a complicated circuit structure and timing design and changing the circuit structure of the electronic equipment and software program.

To fulfill the third object, a liquid crystal display device in accordance with a further aspect of the present invention includes:

a display controller for generating a screenful display data;

counting means for counting the number of lines on the display data;

switching means, connected to the counting means, for deciding where the display data should be stored based on a counted number by the counting means; and a plurality of storage means for storing the display data for each split screen in accordance with a decision by the switching means.

According to the above structure, the number of lines of a screenful data generated by the display controller is counted when an image is displayed. Then, the switching means decides in which storage memory the display data should be stored based on a counted number by the counting means, and switches the output to the storage means. Accordingly, a screenful display data are stored in each storage means for each split screen. In other words, unlike the conventional method in which the display data outputted from the display controller are stored based on the address, the display data are stored based on the number of lines within one screen.

Thus, since a screenful display data are stored into each storage means based on the number of lines independently of the display controller providing address data, neither the liquid crystal display device becomes complicated by including a complicated address converting circuit, nor is the design of the display controller changed. Moreover, the split screens can be driven easier without changing the circuit structure of the electronic equipment or software program.

For a fuller understanding of the nature and advantages of the invention, reference should be made to the ensuing detailed description taken in conjunction with the accompanying drawings.

DESCRIPTION OF THE EMBODIMENTS

First Embodiment

An embodiment of the present invention will be explained in the following while referring to FIGS. 1 through 4.

Figure 1:
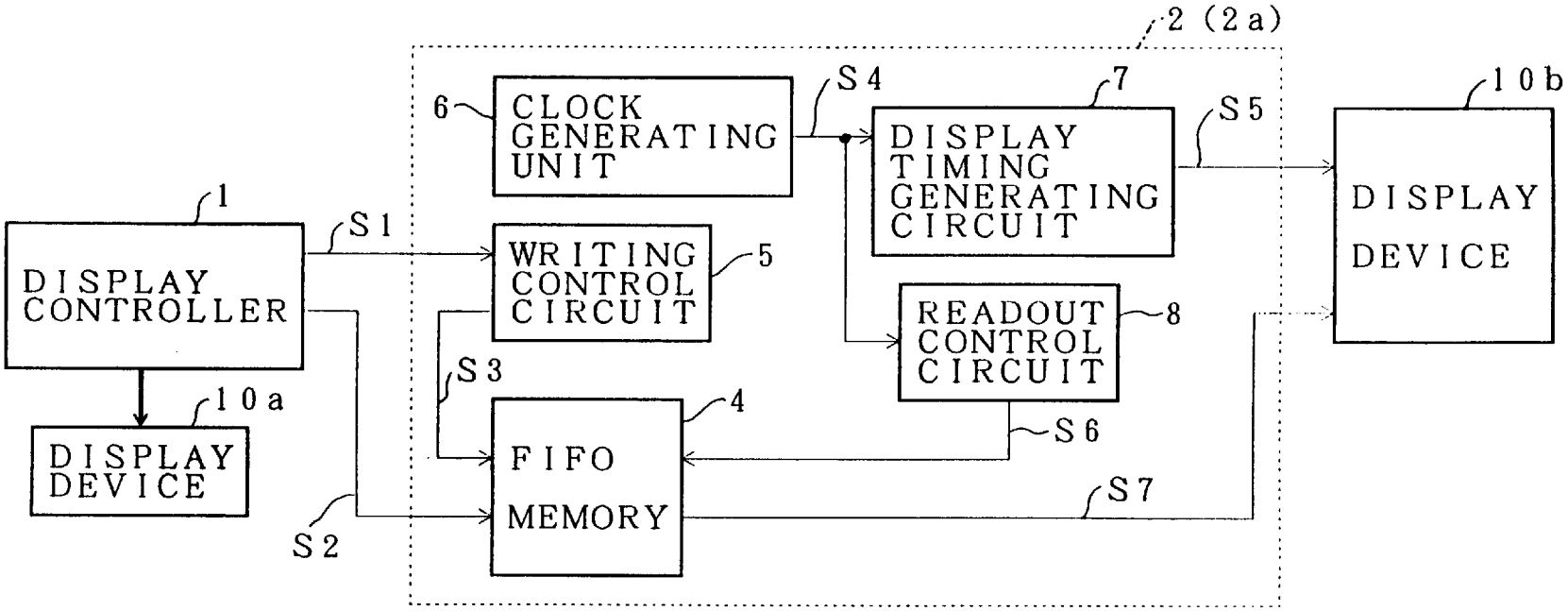
FIG. 1 is a block diagram depicting the entire structure of an electronic equipment and showing a first concrete example of a frequency converting circuit in accordance with a first embodiment of the present invention.

As shown in FIG. 1, electronic equipment of the present embodiment comprises a display controller 1 (interface unit) for displaying display data from an unillustrated main body, a frequency converting circuit 2 (frequency converting means), a low-frequency driven display device 10*a*, and a high-frequency driven display device 10*b*.

The display controller 1 outputs a timing signal S1 and display data S2 whose first frame frequency is in sync with the first timing signal S1 to the frequency converting circuit 2 and the display unit 10*a*.

The frequency converting circuit 2 converts the display data S2 of the first frame frequency into display data S7 of a second frame frequency. The second frame frequency is higher than the first frame frequency and a non-integral multiple of the first frame frequency. Subsequently, the frequency converting circuit 2 outputs a timing signal S5 asynchronous with the timing signal S1, and the display data S7 of the second frame frequency synchronous with the timing signal S5 to the display device 10*b*.

The display device 10*a* is, for example, an active matrix type liquid crystal display device or a CRT (cathode ray tube) display device, and the display device 10*b* is, for example, a direct matrix type liquid crystal display device.

The first frame frequency is set to a frequency that enables the display device 10*a* to render optimal display characteristics, while the second frame frequency is approximated to a frequency that enables the display device 10*b* to render the optimal display characteristics.

According to the above structure, the display device 10*a* displays an image based on the timing signal S1 and display data S2 from the display controller 1, while the display device 10*b* displays an image based on the timing signal S5 and display data S7 from the frequency converting circuit 2.

Since the first frame frequency is set to a frequency that enables the display device 10*a* to render the optimal display characteristics, the display device 10*a* displays a high-quality image.

The second frame frequency is converted into a frequency which is a non-integral multiple of the first frame frequency by the frequency converting circuit 2. Thus, unlike the conventional electronic equipment in which the second frame frequency as the result of the frequency conversion is an integral multiple of the first frame frequency, the electronic equipment of the present invention can approximate the second frame frequency to a frequency that enables the display device 10*b* to render the optimal display characteristics. As a result, the display device 10*b* can also display a high-quality image without ghosts or flickers on the screen.

Further, by additionally providing the frequency converting circuit 2 to the display controller 1 identical with the display controller of the conventional electronic equipment, the electronic equipment can display a high-quality image respectively on the display device 10*a* driven by the first frame frequency and display device 10*b* driven by the second frame frequency higher than the first frame frequency.

Also, the electronic equipment may additionally include selecting means that enables a selection whether both or either of the display data S2 from the display controller 1 and the display data S7 from the frequency converting circuit 2 are outputted. Accordingly, both the display devices 10*a* and 10*b* display images simultaneously in some cases, and only one of them displays an image in other cases, which upgrades the operability of the electronic equipment.

Three concrete examples of a structure of the frequency converting circuit 2 will be given in the following.

First Concrete Example

As shown in FIG. 1, a frequency converting circuit 2*a* comprises a FIFO (first-in-first-out)memory) memory 4 (frame memory) for storing the display data S2 of one frame, and a writing control circuit 5 (writing means) for outputting a writing control signal S3 to the FIFO memory 4 based on the timing signal S1 from the display controller 1 to write the display data S2 from the display controller 1 into the FIFO memory 4.

The frequency converting circuit 2*a* further comprises a clock generating unit 6 for generating a standard clock S4, a display timing generating circuit 7 for outputting a timing signal S5 to the display device 10*b* based on the standard clock S4, and a readout control circuit 8 for outputting a readout control signal S6 to the FIFO memory 4 based on the standard clock S4 to readout data from the FIFO memory 4. In other words, the readout means of this embodiment of the present embodiment comprises the clock generating unit 6, and readout control circuit 8, and display timing generating circuit 7.

According to the above structure, the display data S2 from the display controller 1 are written into the FIFO memory 4 as image data based on the writing control signal S3. Having been written into the FIFO memory 4, the image data are read out from the FIFO memory 4 based on the readout control signal S6, and sent to the display device 10*b* as the display data S7.

The frequency of the standard clock S4 is set in such a manner that the image data are read out from the FIFO memory 4 faster than they are written into the same. As a result, the display data S7 are generated to have the second frame frequency higher than the first frame frequency of the display data S2, and the image data can be read out a number of times from the FIFO memory 4 while the image data of one frame are written into the same.

Figures 2A, 2B, 2C, 2D:
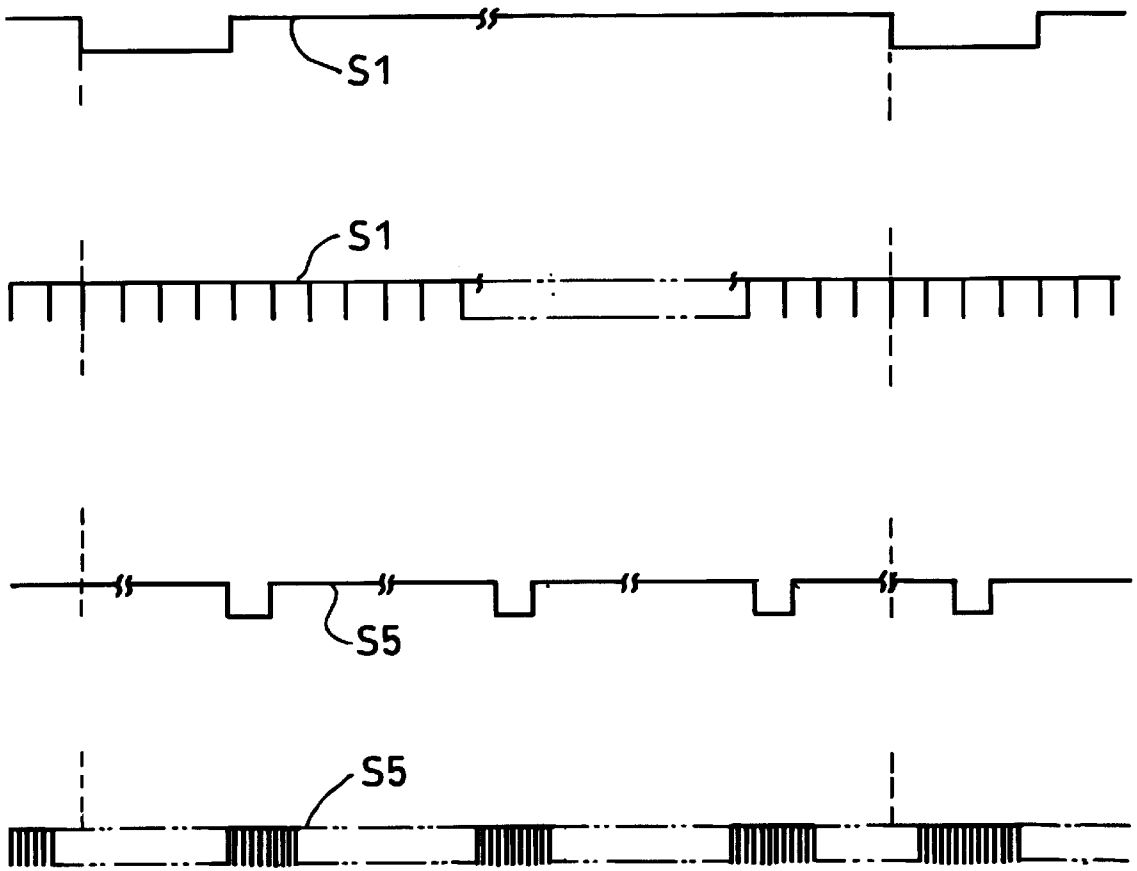
FIGS. 2(*a*)–2(*d*) is a view showing a waveform representing a timing signal of the electronic equipment of FIG. 1.

The standard clock S4 is asynchronous with the timing signal S1, and so is the timing signal S5 as shown in FIGS. 2(*a*) through 2(*d*). Since the standard clock S4 can be made asynchronous with the timing signal S1, a conventionally indispensable PLL (Phase locked Loop) circuit or the like for generating a synchronous clock is omitted herein, thereby simplifying the circuit structure.

When the n'th frame in the display data S2 switches to the n+1'th frame, the readout address may over pass the writing address while the data of one frame are being written, and a frame may have a mixture of the data of the n'th image screen and the n−1'th image screen. However, since such a phenomenon occurs only once in a number of frames, it can be neglected when displayed on the screen and does not cause any visual problem. The frame referred herein means scanning from the first line to the last line of the screen, and one image screen referred herein means a period represented by a unit of frames, in which the same display data are scanned for some frames.

Second Concrete Example

Figure 3:
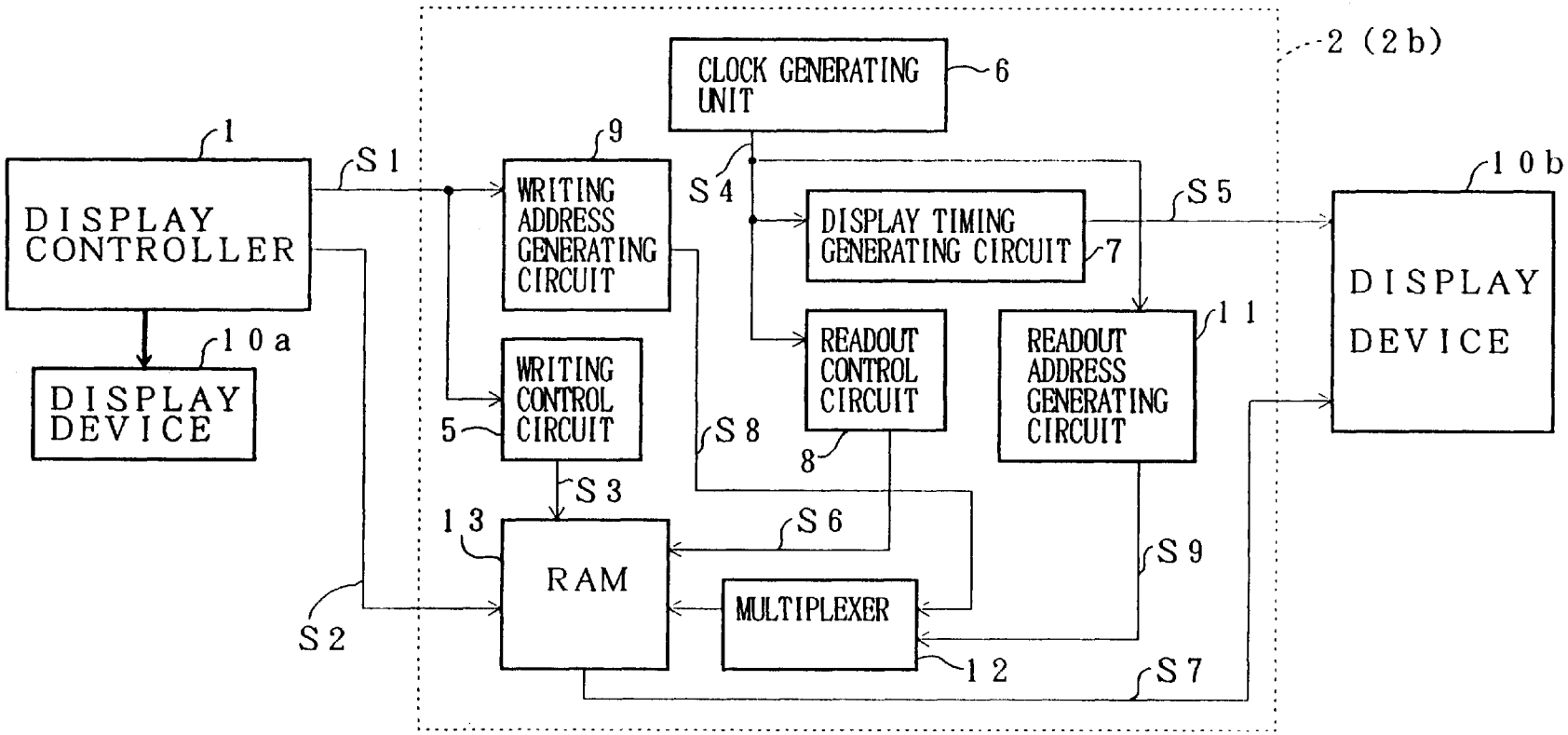
FIG. 3 is a block diagram showing the structure of a second concrete example of the frequency converting circuit of the electronic equipment of FIG. 1.

A s shown in FIG. 3, a frequency converting circuit 2*b* comprises a dual port RAM 13 (frame memory), a writing address generating circuit 9, a readout address generating circuit 11, and a multiplexer circuit 12 in addition to the writing control circuit 5, clock generating unit 6, display timing generating circuit 7, and readout control circuit 8 of the frequency converting circuit 2*a* in the first concrete example.

The writing address generating circuit 9 outputs a writing address signal S8 based on the timing signal S1 from the display controller 1 to designate an address (writing address) in the RAM 13 into which the image data are written.

The readout address generating circuit 11 outputs a readout address signal S9 based on the standard clock S4 from the clock generating unit 6 to designate an address (readout address) in the RAM 13 from which the image data are read out.

The multiplexer circuit 12 receives both the writing address signal S8 and readout address signal S9, and switches between the same in such a manner that the RAM 13 receives the former when the image data are written thereinto, and the latter when the image data are read out therefrom.

In the frequency converting unit 2*b*, the readout means comprises the clock generating unit 6, display timing generating circuit 7, readout control circuit 8, readout address generating circuit 11 (readout address generating unit), and multiplexer circuit 12. On the other hand, the writing means comprises the writing control circuit 5, writing address generating circuit 9 (writing address generating unit), and multiplexer circuit 12.

According to the above structure, the frequency converting circuit 2*b* operates in the same manner as the above-explained frequency converting circuit 2*a* except that the display data S2 from the display controller 1 are written into the RAM 13 at an address designated by the writing address generating circuit 9 based on the writing control signal S3, while the image data of one frame written into the RAM 13 are read out from an address designated by the readout address generating circuit 11 based on the readout signal control signal S6 and sent to the display device 10*b* as the display data S7.

Third Concrete Example

Figure 4:
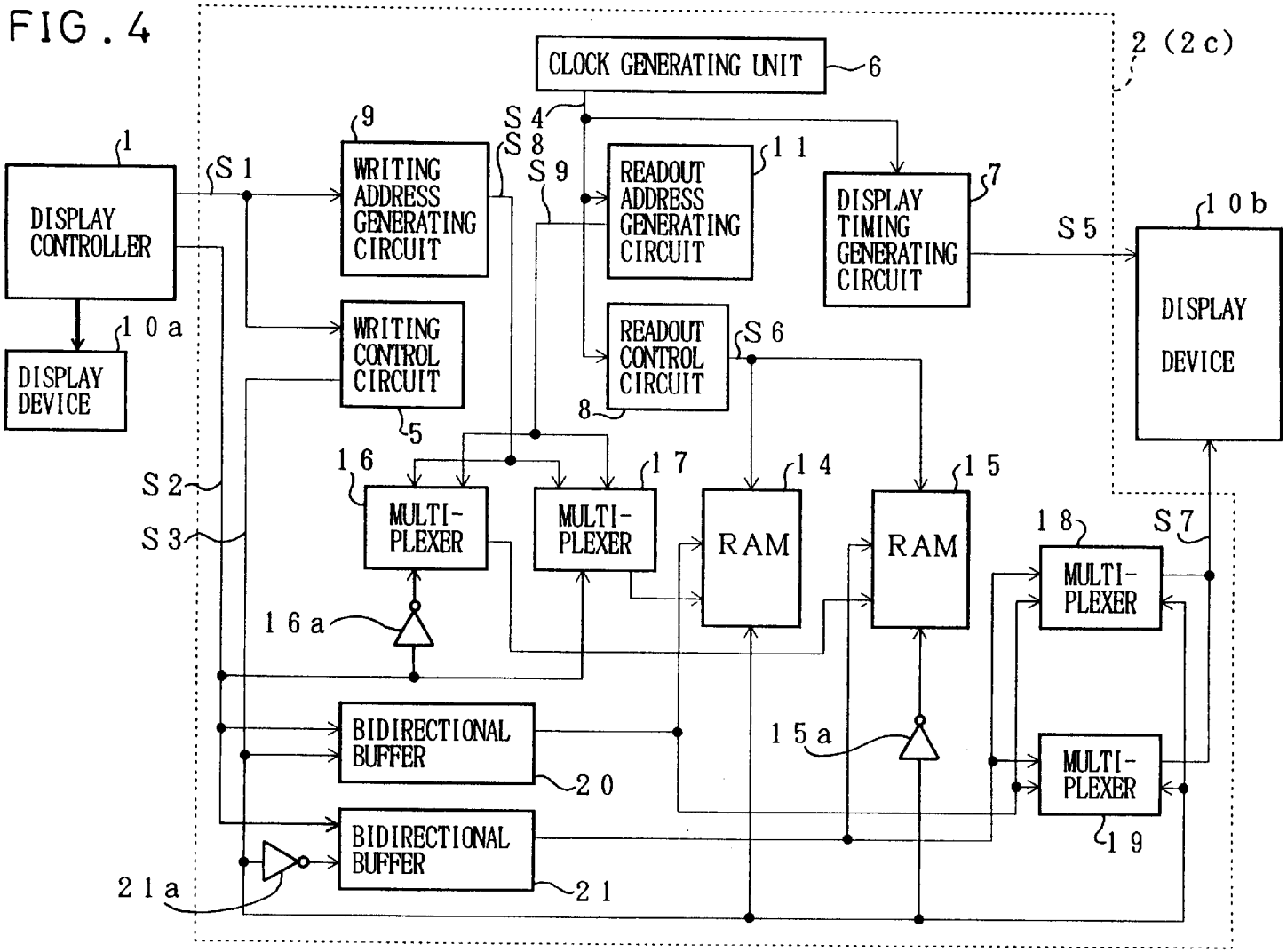
FIG. 4 is a block diagram showing the structure of a third concrete example of the frequency converting circuit of the electronic equipment of FIG. 1.

As shown in FIG. 4, a frequency converting circuit 2*c* comprises two RAMs 14, 15 (storage units) serving as the frame memories, which may be SRAMs (static RAMs) or DRAMs (dynamic RAMs). Like the frequency converting circuit 2*b* in the second concrete example, the frequency converting circuit 2*c* further comprises the writing control circuit 5, clock generating unit 6, display timing generating circuit 7, readout control circuit 8, writing address generating circuit 9, and readout address generating circuit 11 of the frequency converting circuit 2*a*.

The frequency converting circuit 2*c* further comprises four multiplexer circuits 16, 17, 18, 19, and two bidirectional buffers 20, 21, which enables the switching action between the writing address and readout address, and the writing data and readout data.

Each of the multiplexer circuits 16, 17 receives the writing address signal S8 from the writing address generating circuit 9, the readout address signal S9 from the readout address generating circuit 11, and the display data S2 from the display controller 1. Note that the display data S2 are inputted either the multiplexer circuit 16 or 17 by means of a NOT circuit 16*a*. The output from the multiplexer circuit 16 is inputted into the RAM 15, while the output from the multiplexer circuit 17 is inputted into the RAM 14.

Each of the bidirectional buffers 20, 21 receives the display data S2 from the display controller 1 and the writing control signal S3 from the writing control circuit 5. The output from the bidirectional buffer 20 is inputted into the RAM 14 and multiplexer circuits 18, 19 while the output from the bidirectional buffer 21 is inputted into the RAM 15 and multiplexer circuits 18, 19.

Each of the multiplexer circuits 18, 19 receives the readout signals from both the RAMs 14, 15 and the writing control signal S3 from the writing control circuit 5, and outputs the display data S7.

Note that when the bidirectional buffer 20 and RAM 14 are receiving the writing control signal S3 by means of NOT circuits 21*a*, 15*a* the writing control signal S3 is not supplied to the bidirectional buffer 21, RAM 15, and when the bidirectional buffer 21, RAM 15 are receiving the writing control signal S3 by means of the NOT circuits 21*a*, 15*a* the writing control signal S3 is not supplied to the bidirectional buffer 20, RAM 14.

According to the above structure, the frequency converting circuit 2*c* operates in the same manner as the above-explained frequency converting circuit 2*a* except that the two RAMs 14, 15 are switched to serve as the writing and readout frame memories each time the image data of one frame are written. That is to say, the two RAMs 14, 15 are used alternately as the writing and readout frame memories. More precisely, the RAM 14 is used as the writing frame memory while the RAM 15 is used as the readout memory at the n'th frame, and the RAM 14 is used as the readout frame memory while the RAM 15 is used as the writing memory at the following n+1'th frame.

For example, the following explains when the RAM 14 is used as the writing frame memory and the RAM 15 is used as the readout frame memory. The display data S2 are written into the RAM 14 under the control of the writing control signal S3 inputted into the bidirectional buffer 20. Note that the multiplexer circuit 17 selects the writing address signal S8, and the display data Sare written into a desired address in the RAM 14 based on the writing address signal S8.

On the other hand, the data are read out from a desired address in the RAM 15 based on the readout control signal S6 and the readout address signal S9 selected by the multiplexer circuit 16, and inputted into the multiplexer circuit 18. Accordingly, the display data S7 are outputted from the multiplexer circuit 18. Note that the multiplexer circuit 19 has a high impedance at this time so as not to receive the output data from the RAM 15.

As has been explained, using the FIFO memory 4 or dual port RAM 13 as the frame memory enables a high-quality display even when the second frame frequency is high, and when an inexpensive SRAM or DRAM is used as the frame memory, a high-quality display can be realized as well by providing two RAMs 14, 15 to serve as the frame memories and using the same alternately per frame.

Second Embodiment

Figure 6:
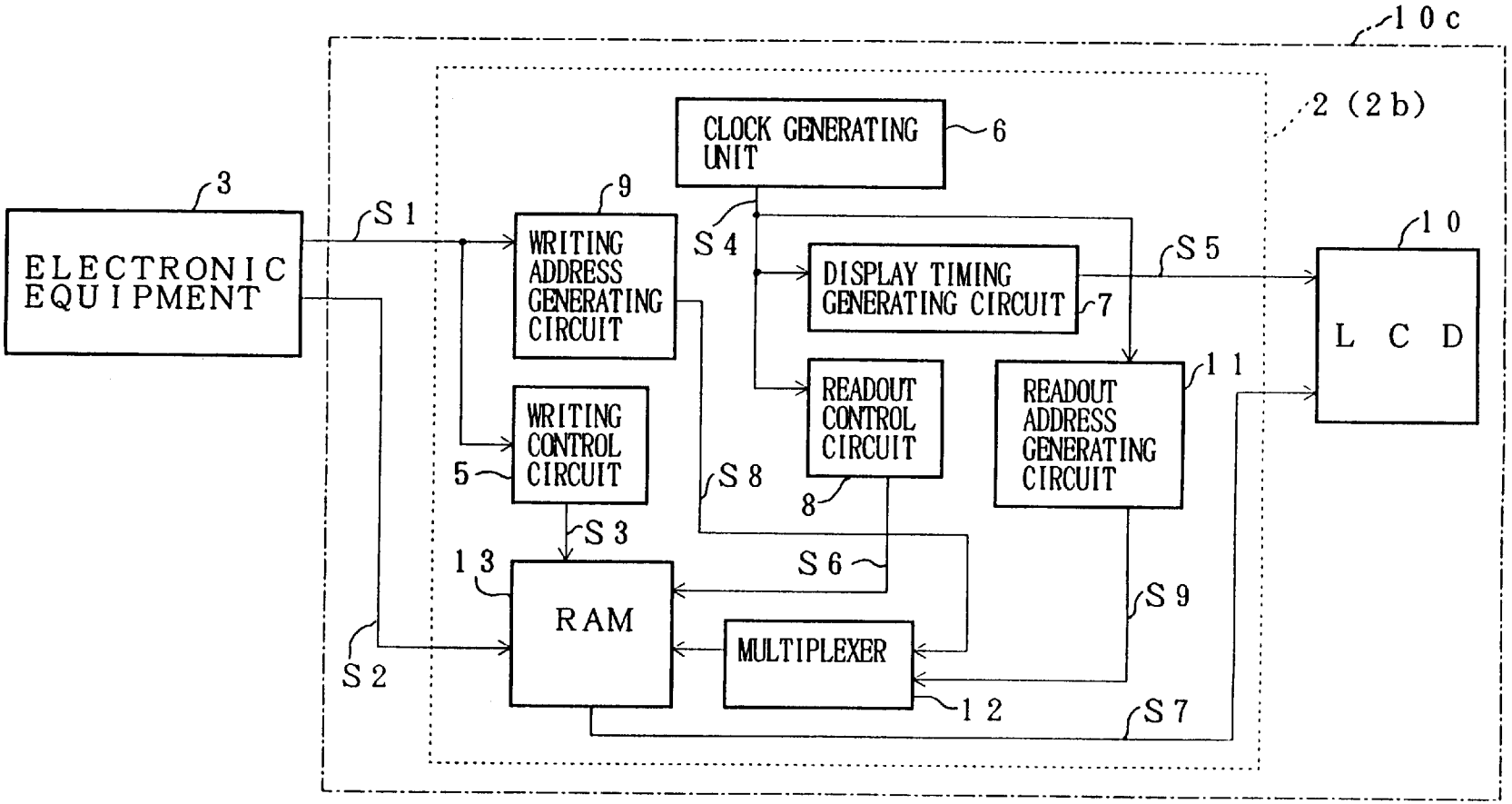
FIG. 6 is a block diagram depicting the structure of a liquid crystal display device employing the frequency converting circuit of the second concrete example.
Figure 7:
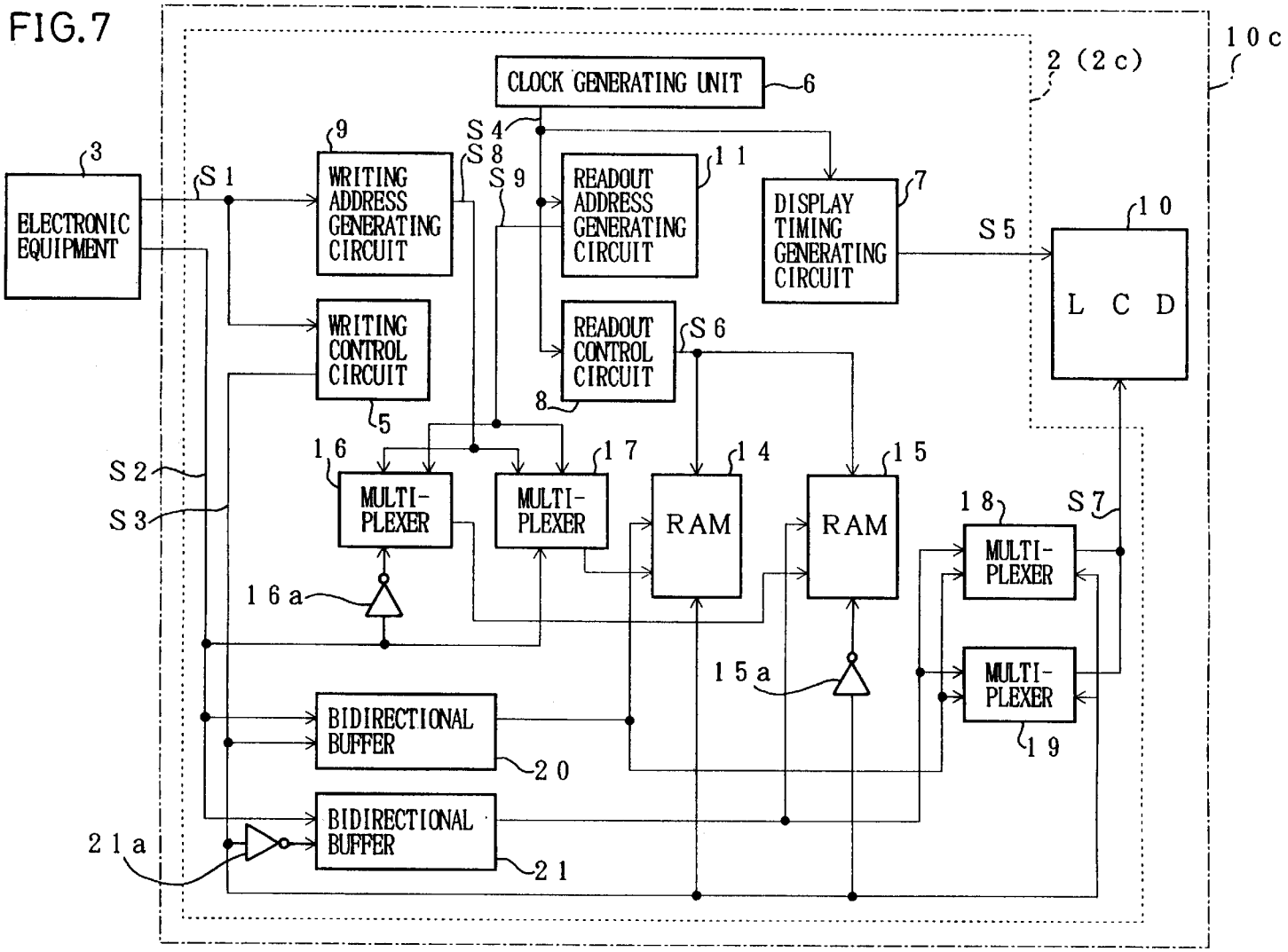
FIG. 7 is a block diagram depicting the structure of a liquid crystal display device employing the frequency converting circuit of the third concrete example.

Another embodiment of the present invention will be explained in the following while referring to FIGS. 5 through 7. Hereinafter, like components are labelled with like numeral references with respect to the first embodiment and the description of these components is not repeated for the explanation's convenience.

Figure 5:
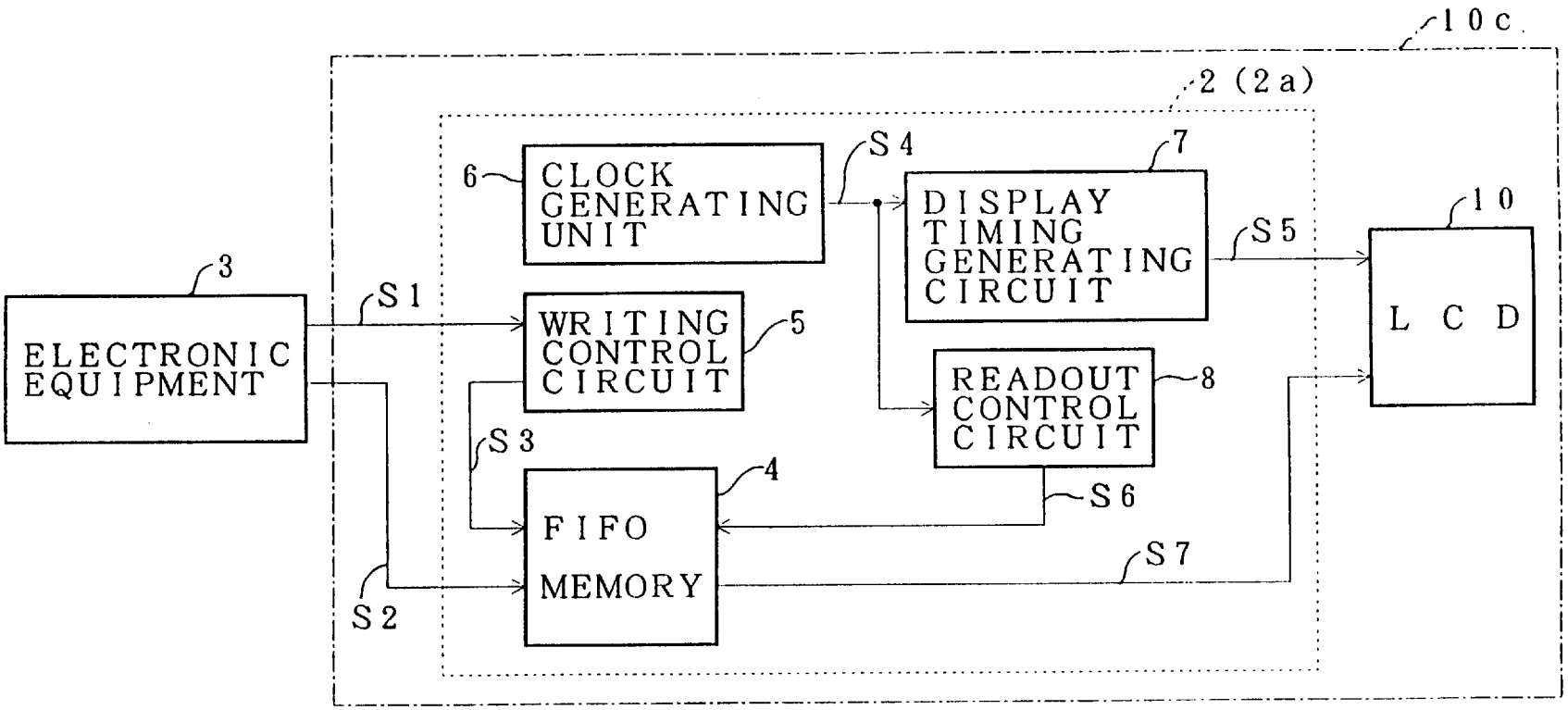
FIG. 5 is a block diagram depicting the entire structure of a liquid crystal display device in accordance with a second embodiment of the present invention employing the frequency converting circuit of the first concrete example.

As shown in FIG. 5, a liquid crystal display device 10*c* of the present embodiment comprises a liquid crystal display unit 10 and a frequency converting circuit 2. Although it is not shown in the drawing, the liquid crystal display unit 10 comprises a direct matrix type liquid crystal panel and a driving circuit which drives the liquid crystal panel line-sequentially by the average voltage driving method. The frequency converting circuit 2 converts an image signal of a first frame frequency from electronic equipment 3 to output an image signal of a second frame frequency which is higher than the first frame frequency to the driving circuit of the liquid crystal display unit 10.

According to the above structure, the image signal of the first frame frequency from the electronic equipment 3 is inputted into the frequency converting circuit 2, which accordingly converts the same into the image signal of the second frame frequency which is higher than the first frame frequency. Subsequently, the image signal of the second frame frequency is inputted into the driving circuit of the liquid crystal display unit 10. The driving circuit drives the liquid crystal panel based on the image signal of the second frame frequency to display an image on the liquid crystal panel.

Here, the second frame frequency is set to a high frequency (e.g., 80 Hz or more) to prevent the above-described frame response phenomenon to allow a high-contrast image display. In addition, since the electronic equipment 3 is not accelerated, an increase in the cost caused by such acceleration can be prevented.

In addition, a CRT display device and/or an active matrix type display device, representing the display devices which, in principle, would not cause the frame response phenomenon when driven by the image signal of the relatively low first frame frequency from the electronic equipment 3, can be used selectively with the liquid crystal display device 10*c* of the present invention. In other words, since the liquid crystal display device 10*c* of the present invention uses the conventional electronic equipment 3, not only the liquid crystal display device 10*c*, but also the conventional CRT display device and/or active matrix type display device can be connected to the electronic equipment 3 in the conventional manner to display an image.

The frequency converting circuit 2 is of the same structure as the circuit explained in the first through third concrete examples in the first embodiment. Note that, however, the frequency converting circuit 2 of the first embodiment is connected to the display controller 1 and liquid crystal display unit 10*b* at its input side and output side, respectively, whereas the frequency converting circuit 2 of the present embodiment is connected to the electronic equipment 3 and liquid crystal display unit 10 at the input side and output side, respectively.

In the drawing, the timing signal S1 and display data S2 from the electronic equipment 3 correspond to the image signal of the first frame frequency. The timing signal S1 is composed of a vertical synchronous signal Vsync of 40–70 Hz and a horizontal synchronous signal determined by the frequency of vsync in FIGS. 2(*a*) and 2(*b*) used in the first embodiment.

Likewise, the timing signal S5 from the display timing generating circuit 7, display data S7 sent to the liquid crystal display unit 10 from the FIFO memory 4 correspond to the image signal of the second frame frequency. The timing signal S5 is composed of a vertical synchronous signal Vsync of 100–300 Hz and a horizontal synchronous signal determined by the frequency of vsync shown in FIGS. 2(*c*) and 2(*d*).

Note that the standard clock S4 is not necessarily in sync with the timing signal S1, and hence neither is the timing signal S5 (refer to FIGS. 2(*a*) and 2(*c*)).

Third Embodiment

A further embodiment of the present invention will be explained in the following while referring to FIG. 8. Note that the like components are labelled with like numeral references with respect to the above embodiments, and the description of these components is not repeated for the explanation's convenience.

Figure 8:
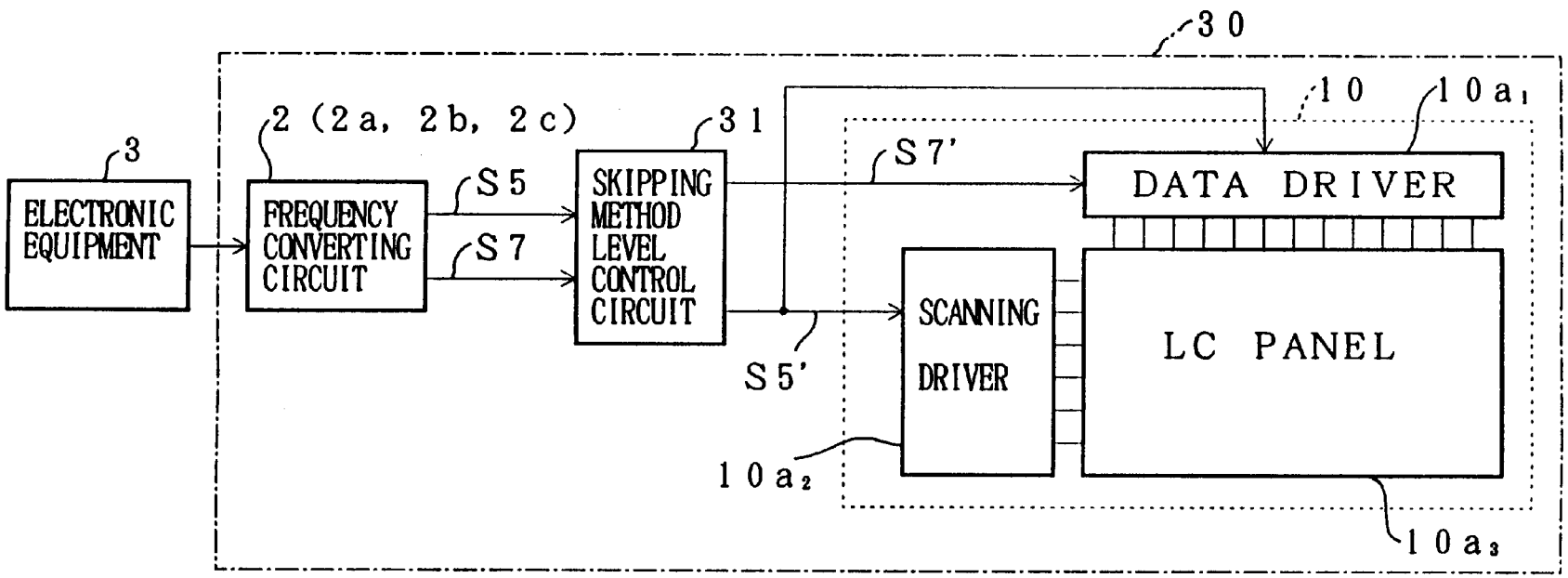
FIG. 8 is a block diagram depicting the entire structure of a liquid crystal display device in accordance with a third embodiment of the present invention employing a skipping method level control circuit.
Figure 9:
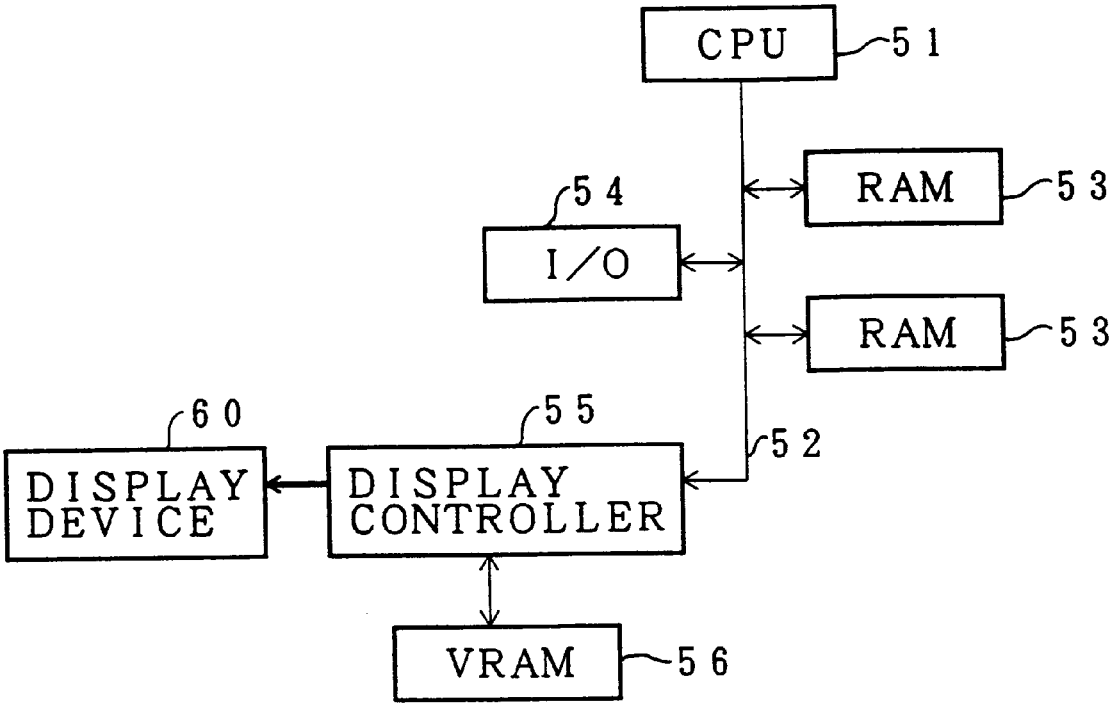
FIG. 9 (PRIOR ART)
FIG. 9 is block diagram depicting the structure of conventional electronic equipment furnished with a display device.
Figure 10:
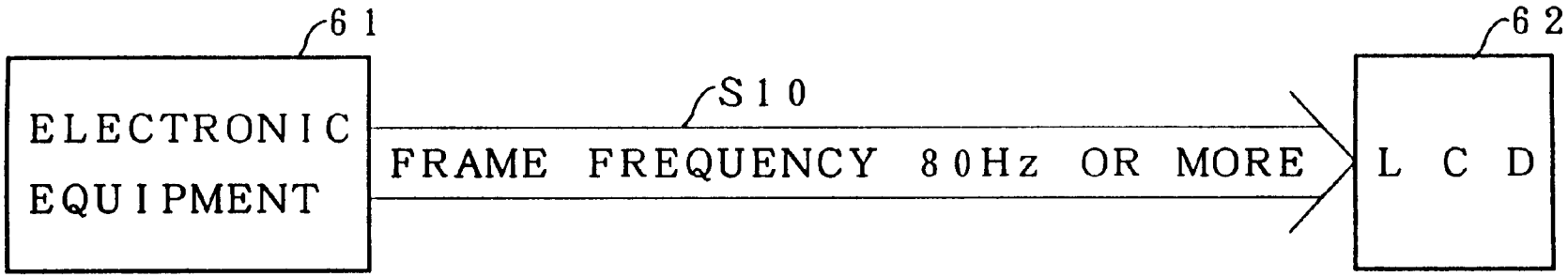
FIG. 10 (PRIOR ART)
FIG. 10 is a view explaining another conventional electronic equipment in which the frame frequency of output image data to the liquid crystal display device is set to 80 Hz or more.
Figure 11:
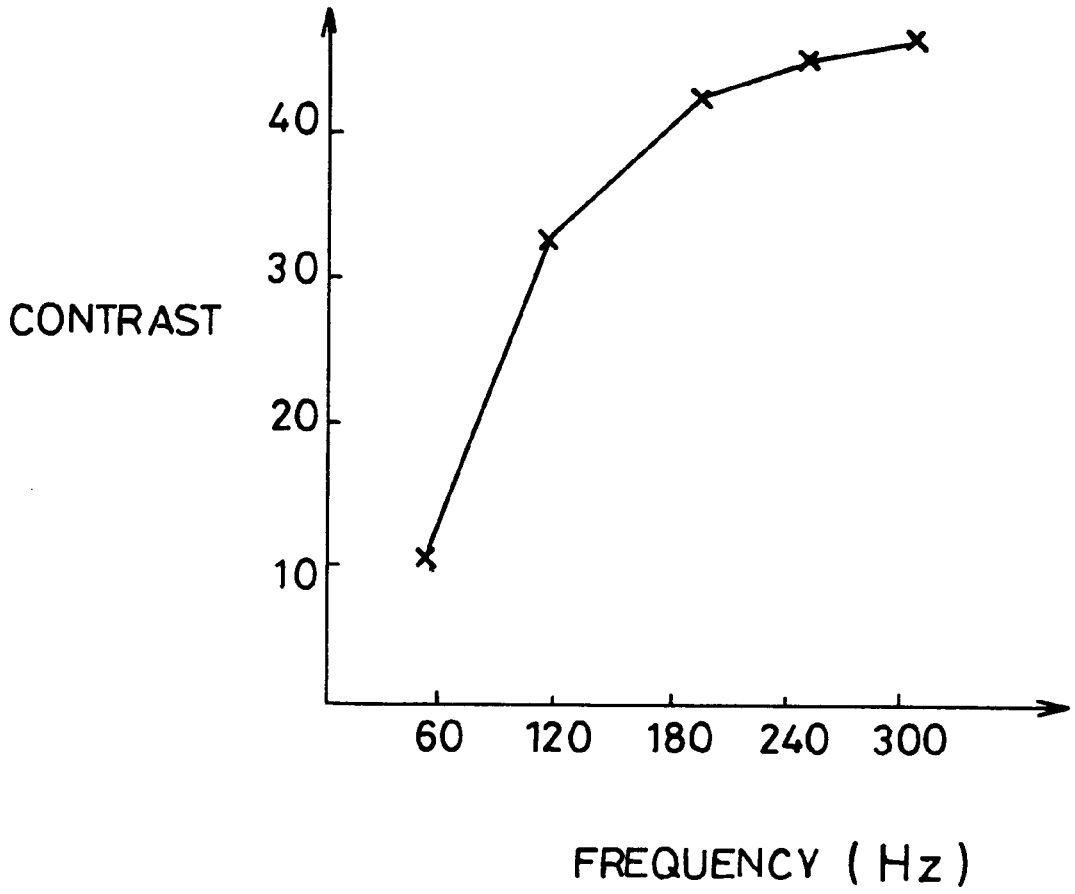
FIG. 11 (PRIOR ART)
FIG. 11 is a graph showing the relation between a frame frequency and contrast with respect to image data outputted to the liquid crystal display device from the electronic equipment.
Figure 12:
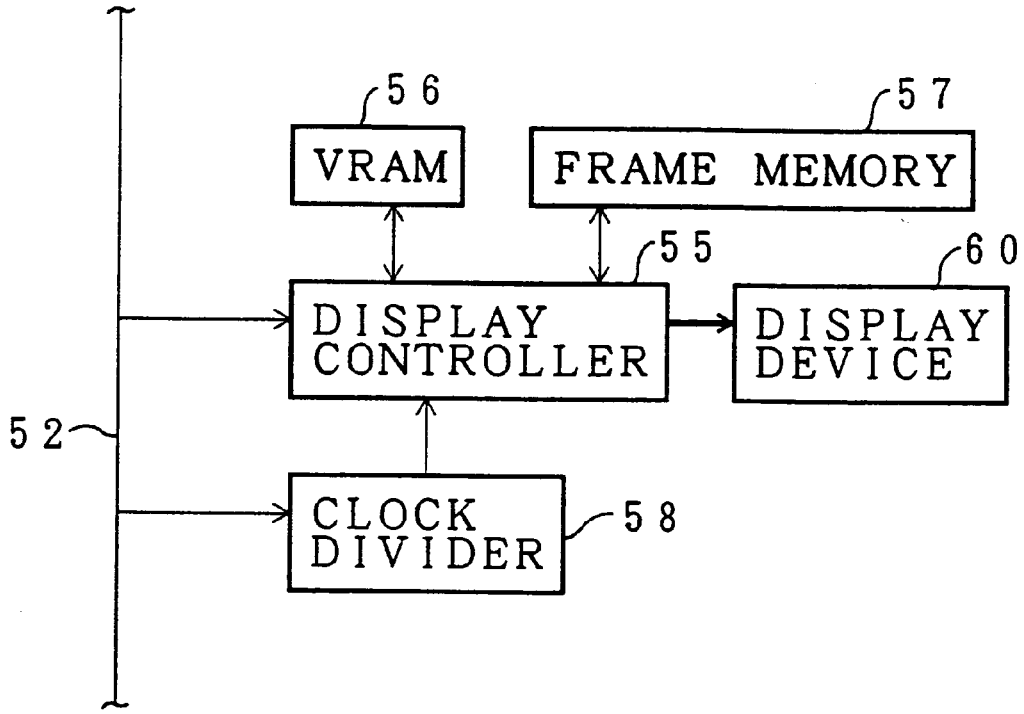
FIG. 12 (PRIOR ART)
FIG. 12 is a block diagram depicting the structure of the conventional electronic equipment of FIG. 9 when it additionally includes a frame memory.

As shown in FIG. 8, a liquid crystal display device 30 of the present embodiment is of the same structure of the frequency converting circuit 2 (2*a*, 2*b* and 2*c*) and liquid crystal display unit 10 of the second embodiment except that it additionally includes the skipping method level control circuit 31 (skipping method level control means). The liquid crystal display unit 10 is composed of a data driver $\mathbf{10}a_1$ and a scanning driver $\mathbf{10}a_2$ serving as driving circuits (driving means), and a liquid crystal panel $\mathbf{10}a_3$.

Conventionally, using the skipping method level control circuit 31 increases the number of colors available for display, while it presents a problem that the contrast degrades and the screen flickers. However, employing the above frequency converting circuit 2 makes it possible to display a high-contrast image with reduced flickers while making a great number of colors available.

According to the above structure, upon input of the image signal (including RGB digital data) of the first frame frequency from the electronic equipment 3, the frequency converting circuit 2 converts the same into the image signal of the second frame frequency which is higher than the first frame frequency. The image signal of the second frame frequency (the display timing signal S5 and display data S7) are inputted into the skipping method level control circuit 31, which accordingly applies a predetermined skipping method level processing to the input data to output display data S7' and a timing signal S5'. The former are inputted into the data driver $\mathbf{10}a_1$ in the driving circuit of the liquid crystal display unit 10, while the latter, composed of a latch pulse and a start pulse, is inputted into the scanning driver $\mathbf{10}a_2$ and data driver $\mathbf{10}a_1$. As a result, an image is displayed on the liquid crystal panel $\mathbf{10}a_3$.

Fourth Embodiment

Still another embodiment of the present invention will be explained in the following while referring to FIGS. 13 through 16. A liquid crystal panel driving device herein is employed in, for example, a direct matrix type liquid crystal display device.

Figure 13:
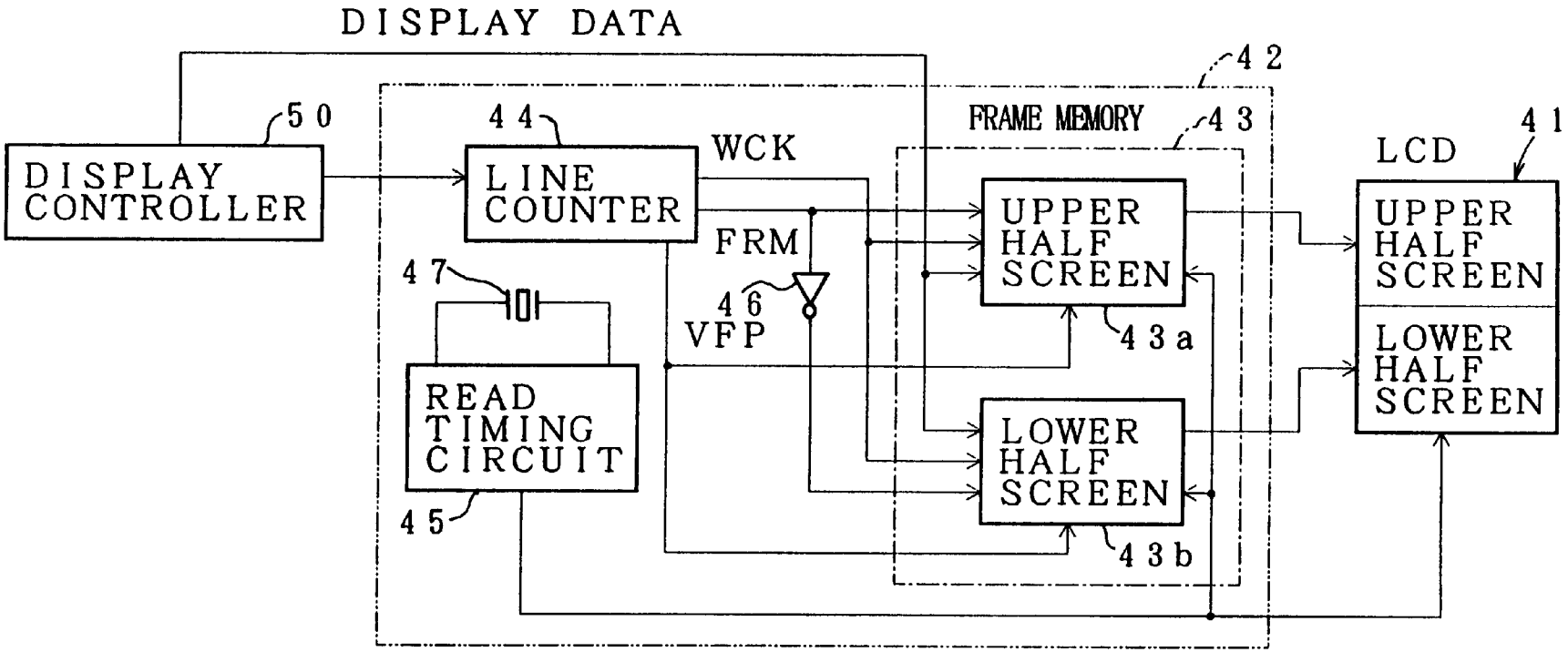
FIG. 13 is a block diagram depicting the entire structure of a liquid crystal display device and the structure of a driving device of a liquid crystal panel in accordance with a fourth embodiment of the present invention.

As shown in FIG. 13, a liquid crystal display device of the present embodiment comprises a liquid crystal panel (hereinafter referred to as LCD) 41 of 320×240 dots, a driving device 42 for driving the LCD 41, and a display controller 50 for generating display data and sending the same to the driving device 42 to be displayed on the LCD 41.

The driving device 42 comprises a frame memory 43, a line counter 44 (counting means), and a read timing circuit 45 (readout means).

The frame memory 43 comprises a VRAM (Video RAM) of a dual port RAM, and is connected directly to LCD driving circuits 48, 49 of the LCD 41 to store the frame data for the LCD 41, which will be described below. The frame memory 43 further comprises an upper half screen memory 43*a* (storage means) for storing the frame data for the upper half screen of the LCD 41, and a lower half screen memory 43*b* (storage means) for storing the frame data for the lower half screen of the LCD 41. Both the upper half screen memory 43*a* and lower half screen memory 43*b* are connected to the display controller 50, so that the display data for the LCD 41 generated by the display controller 50 are stored either in the upper half screen memory 43*a* or lower half screen memory 43*b* under the control of the line counter 44.

The line counter 44 receives a screenful data from the display controller 50, and starts to count the horizontal synchronous signals from the display start line. The line counter 44 also controls a NOT circuit 46 (switching means), which is provided in a path of a memory writing control signal FRM, and distributes the display data either to the upper half screen memory 43*a* or lower half screen memory 43*b* using the count value, and determines the writing start position using a start position control signal VFP. The line counter 44 further controls a writing time using a writing clock signal WCK.

Figure 14:
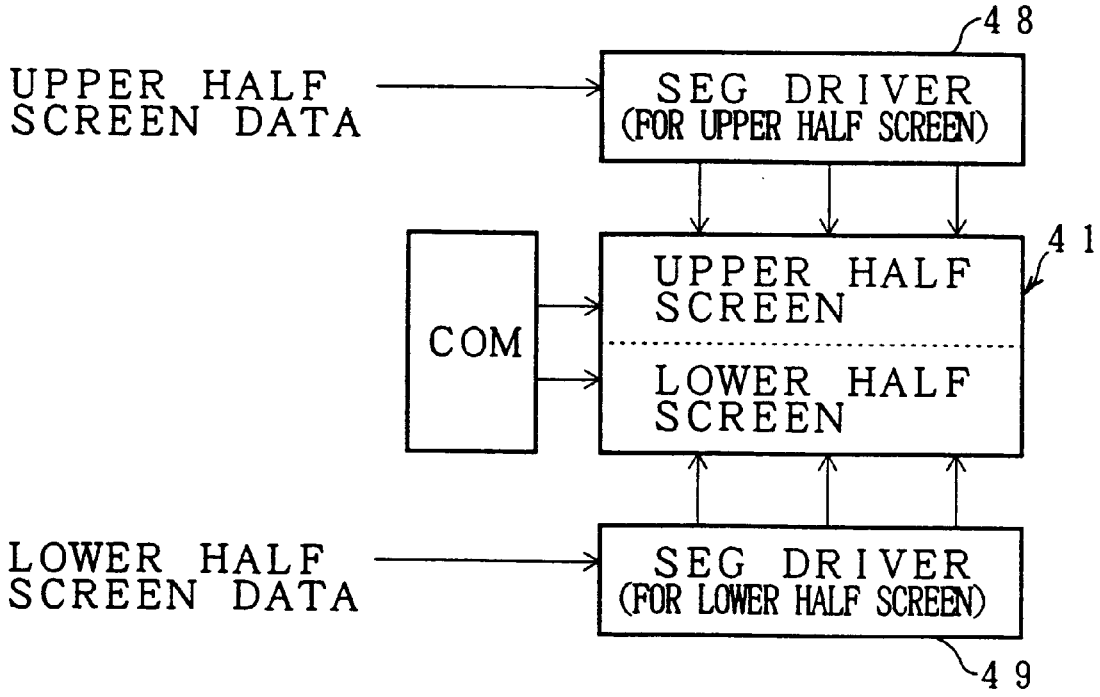
FIG. 14 is a view showing the structure of an LCD in the above driving device.

The read timing circuit 45 generates readout timing at which the display data written into the upper half screen memory 43*a* and lower half screen memory 43*b* are outputted to the LCD 41. More precisely, the read timing circuit 45 reads out the display data from the upper half screen memory 43*a* and lower half screen memory 43*b* simultaneously using a horizontal synchronous signal by a clock 47, and sends the same to the LCD driving circuits (SEG drivers) 48, 49 as shown in FIG. 14. Here, the horizontal synchronous signal is about half the cycle of a cycle at the time of writing and the clock 47 is either synchronous or asynchronous with the writing clock signal WCK.

The driving operation of the LCD 41 by the above-structured driving device 42 will be explained in the following.

Figure 15:
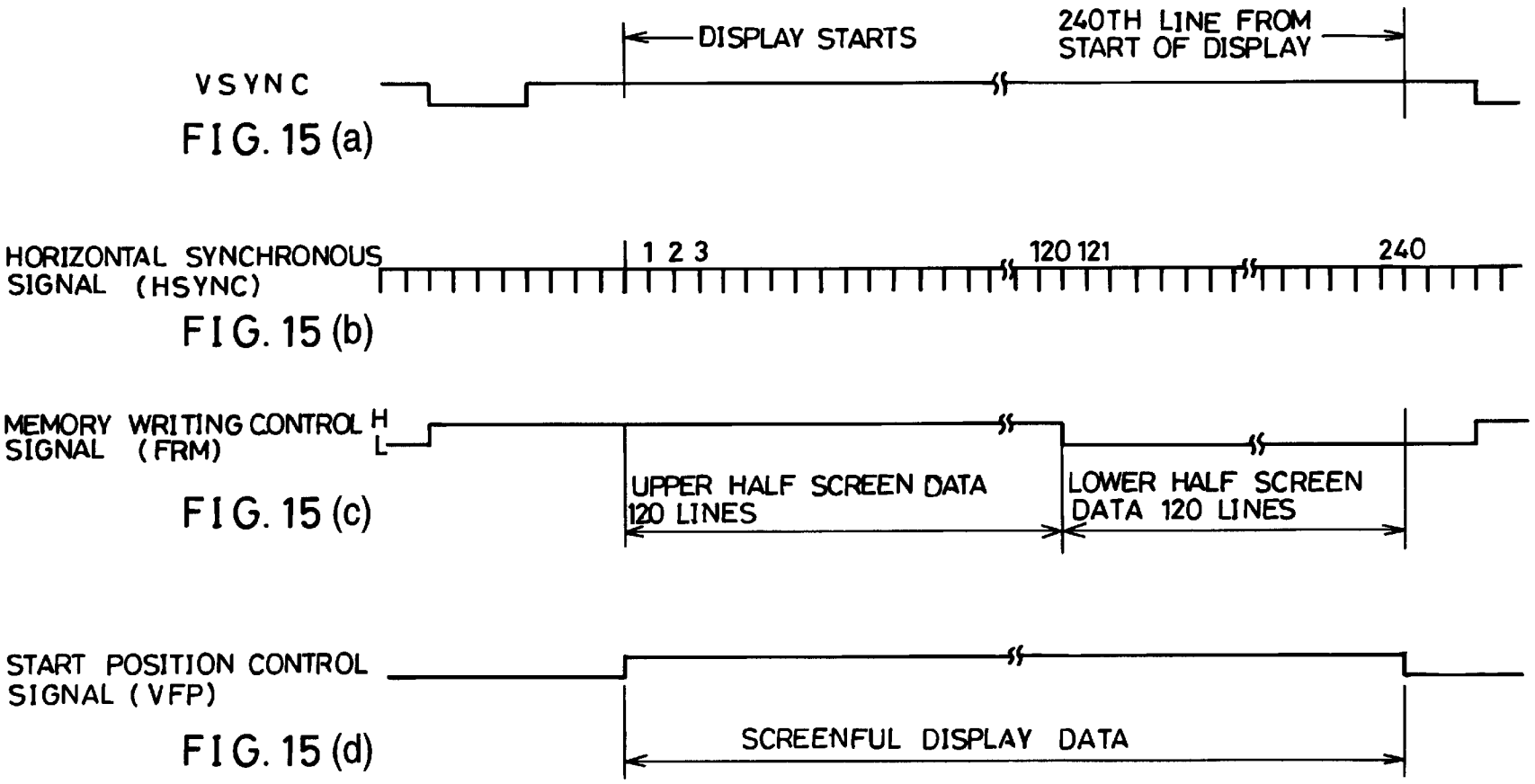
FIG. 15(*a*)–15(*d*) is a time chart representing a control operation of a line counter of the driving device.
Figure 16:
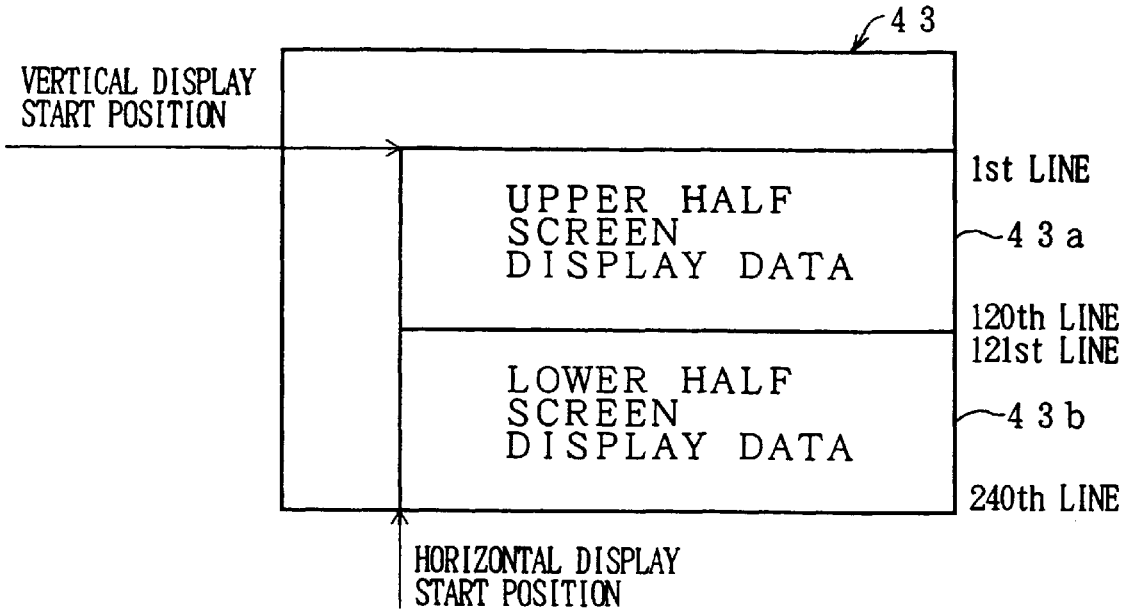
FIG. 16 is a view explaining how display data are stored in a frame memory of the driving device.
Figure 17:
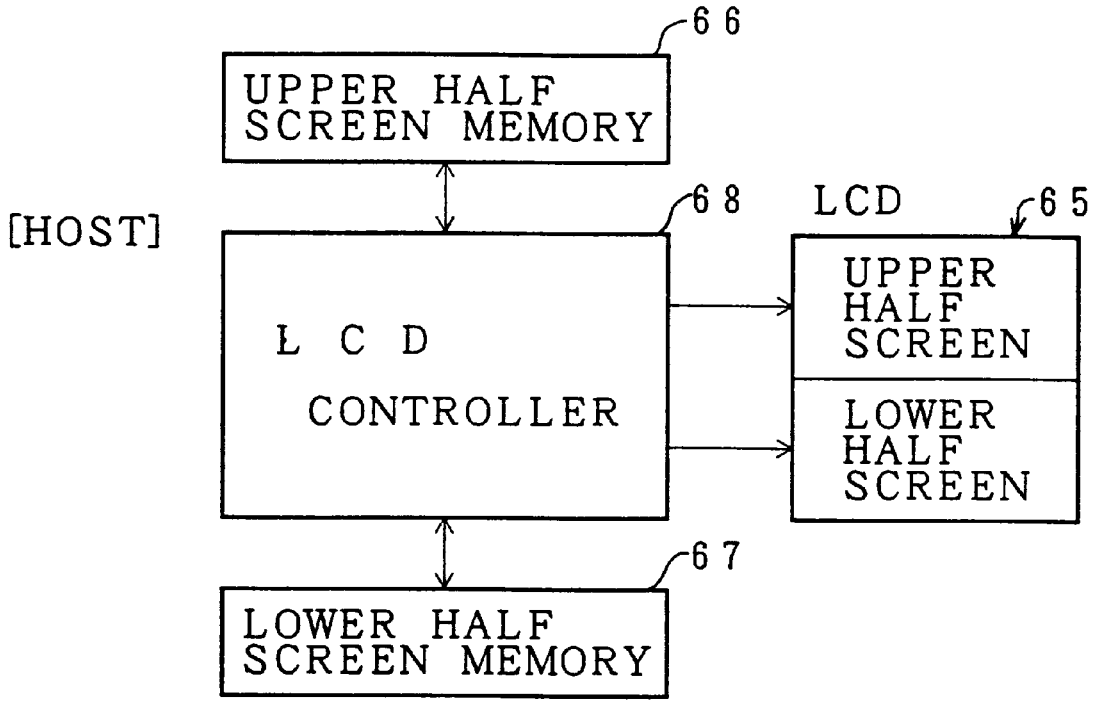
FIG. 17 (PRIOR ART)
FIG. 17 is a view showing the structure of a conventional driving device which writes the display data stored in a VRAM into an LCD through an LCD controller.
Figure 18:
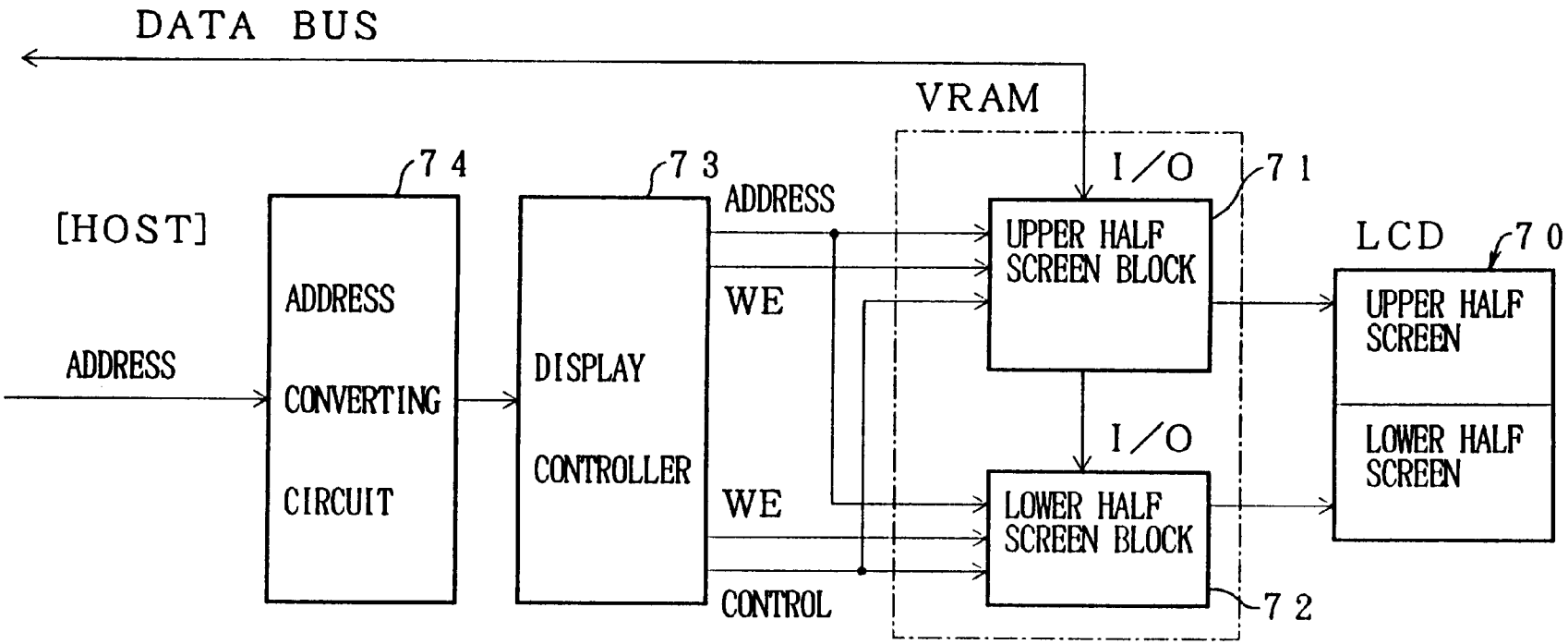
FIG. 18 (PRIOR ART)
FIG. 18 is a block diagram showing another conventional structure of a driving device which converts an address of the display data stored in a VRAM by an address converting circuit.

As shown in FIG. 13, the driving device 42 receives a screenful display data sent from the display controller 50. Then, as shown in FIGS. 15(*a*)–15(*d*) the line counter 44 of the driving device 42 starts to count the horizontal synchronous signals from the display start line, and when it counts up to 120 lines, it reverses the memory writing control signal FRM from "H" to "L" using the NOT circuit 46. As a result, the display data are written into the upper half screen memory 43*a* while the memory writing control signal FRM exhibits "H". At the same time, the display data for the first line of the display image are stored at the leading address of the upper half screen memory 43*a* by controlling the writing start position using the start position control signal VFP, and the rest of the display data for the second through 120'th lines are sequentially stored into the following addresses as shown in FIG. 16.

As shown in FIG. 15, the memory writing control signal FRM exhibits "L" from the 121'st line of the display data, and the display data are written into the lower half screen memory 43*b*. The display data for the 121'st through 240'th lines are stored from the leading to the last addresses of the lower half screen memory 43*b* sequentially under the control of the start position control signal VFP (refer to FIG. 16).

Subsequently, the display data written into the upper half screen memory 43*a* and lower half screen memory 43*b* of the frame memory 43 are read out simultaneously by the read timing circuit 45 using the horizontal synchronous signal by the clock 47, which is about half the cycle of a cycle at the time of writing and sent to the LCD driving circuits 48, 49, respectively. The display data thus sent are outputted to the upper half and lower half screens of the LCD 41 from the leading addresses of the upper half screen memory 43*a* and lower half screen memory 43*b*, respectively.

Accordingly, a signal is sent from the display controller 50 in the same manner as the conventional method. Thus, the two split screens of the LCD 41 are driven easily without changing the circuit and software program in the display controller 50, thereby enabling low-duty driving and high-speed frame cycle. In addition, the resulting direct matrix type liquid crystal display device can reduce the frame response phenomenon by making the response faster and upgrade the contrast, and when used for the multi-level display of the skipping method, the resulting direct matrix type liquid crystal display can display a high-quality multi-level image by reducing the flickers on the screen.

Since the readout cycle of the clock 47 is about half the cycle of a cycle at the time of data writing, the readout address may over pass the writing address while the data of one frame are being written when the frames are changing in the writing frame image in the frame memory 43, and a frame may have a mixture of the display data of the n'th image screen and the n-1'th image screen. However, since such a phenomenon occurs only once in a number of frames, it can be neglected when displayed on the screen of the LCD 41.

As has been explained, with the driving device 42 of the present invention, the line counter 44 counts lines of a screenful display data generated by the display controller 50 when displaying an image on the LCD 41. The NOT circuit 46 judges whether the display data are stored into the upper half screen memory 43*a* or lower half screen memory 43*b* based on the count value of the line counter 44, and switches the output to the upper half screen memory 43*a* from the lower half screen memory 43*b* and vice versa. As a result, the screenful display data are distributed to be stored adequately into the upper half screen memory 43*a* and lower half screen 43*b*. Subsequently, the display data stored in the upper half screen memory 43*a* and lower half screen 43*b* are outputted simultaneously to the two split screens of the LCD 41, respectively.

As a result, the display data from the display controller 50 are not stored into the upper half screen memory 43*a* and lower half screen memory 43*b* based on the addresses, but the number of lines.

Thus, a screenful display data can be stored either into the upper half screen memory 43*a* or lower half screen memory 43*b* based on the number of lines independently of the display controller 50 providing the address data. Hence, the liquid crystal display device remains simple by omitting an address converting circuit of a complicated structure, and the display controller 50 can be employed without any change in design. Moreover, the two split screens can be driven easily without changing the circuit structure of the electronic equipment and software program.

Since the read timing circuit 45 reads out the display data to output the same to the upper half screen or lower half screen of the LCD 41 in a shorter time than the time required to store the display data into the upper half screen memory 43*a* or lower half screen memory 43*b*, in other words, faster than the writing speed, the display data can be read out independently of the data storage into the upper half screen memory 43*a* or lower half screen memory 43*b*. As a result, the LCD 41 can perform a high-speed display switching action. In other words, not only the two-screen driving but also the high frame frequency driving can be realized.

The display controller 50 can be used with the other display devices when it is connected to each means of the driving device 42 through the interface. That is to say, the display controller 50 can be employed in the electronic equipment including the other LCDs.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. Electronic equipment comprising:

an interface unit for outputting display data of a first frame frequency; and frequency converting means, connected to said interface unit, for converting the display data of said first frame frequency to output display data of a second frame frequency, said second frame frequency being higher than said first frame frequency and a non-integral multiple of said first frame frequency;

wherein a first timing signal controlling input timing of the display data of said first frame frequency is asynchronous with a second timing signal controlling input timing of the display data of said second frame frequency, and wherein said second timing signal has a frequency which is a non-integral multiple of the frequency of said first timing signal.

2. The electronic equipment as defined in claim 1, wherein said electronic equipment is connected to a direct matrix type liquid crystal display device which displays the display data of said second frame frequency.

3. The electronic equipment as defined in claim 1 further comprising selecting means for selecting whether one of or both of the display data of said first frame frequency from said interface unit and the display data of said second frame frequency from said frequency converting means are outputted.

4. The electronic equipment as defined in claim 3, wherein said electronic equipment is connected to:

(1) one of an active matrix type liquid crystal display device and a cathode ray tube display device, both of which display the display data of said first frame frequency; and (2) a direct matrix type liquid crystal display device which displays the display data of said second frame frequency.

5. The electronic equipment as defined in claim 1, wherein said frequency converting means includes:

writing means for writing the display data of said first frame frequency;

a frame memory, connected to said writing means, for storing the display data of said first frame frequency; and readout means for reading out the display data stored in said frame memory as the display data of said second frame frequency faster than said writing means writes the display data of said first frame frequency.

6. The electronic equipment as defined in claim 5, wherein:

said writing means includes a writing address generating unit for assigning an address of the display data to be written into said frame memory by outputting a writing address signal; and said readout means includes a readout address generating unit for assigning an address of the display data to be read out from said frame memory by outputting a readout address signal, said writing address signal and readout address signal being inputted into said frame memory when the display data are written and read out, respectively.

7. The electronic equipment as defined in claim 5, wherein:

said frame memory includes two storage units;

said writing means includes a writing address generating unit for assigning an address of the display data to be written into said frame memory by outputting a writing address signal; and said readout means includes a readout address generating unit for assigning an address of the display data to be read out from said frame memory by outputting a readout address signal, said writing address signal and readout address signal being inputted into said two storage units alternately.

8. A direct matrix type liquid crystal display device comprising a connector for receiving input display data of a first frame frequency from electronic equipment on a host side and frequency converting means for converting said input display data into display data of a second frame frequency which is higher than said first frame frequency, wherein a first timing signal controlling input timing of the display data of said first frame frequency is asynchronous with a second timing signal controlling input timing of the display data of said second frame frequency, and wherein said second timing signal has a frequency which is a non-integral multiple of the frequency of said first timing signal.

9. The liquid crystal display device as defined in claim 8, wherein said frequency converting means includes:

writing means for writing the display data of said first frame frequency;

a frame memory, connected to said writing means, for storing the display data of said first frame frequency; and readout means for reading out the display data stored in said frame memory as the display data of said second frame frequency faster than said writing means writes the display data.

10. The liquid crystal display device as defined in claim 9, wherein:

said writing means includes a writing address generating unit for assigning an address of the display data to be written into said frame memory by outputting a writing address signal; and said readout means includes a readout address generating unit for assigning an address of the display data to be read out from said frame memory by outputting a readout address signal, said writing address signal and readout address signal being inputted into said frame memory when the display data are written and read out, respectively.

11. The liquid crystal display device as defined in claim 9, wherein:

said frame memory includes two storage units;

said writing means includes a writing address generating unit for assigning an address of the display data to be written into said frame memory by outputting a writing address signal; and said readout means includes a readout address generating unit for assigning an address of the display data to be read out from said frame memory by outputting a readout address signal, said writing address signal and readout address signal being inputted into said two storage units alternately.

12. A liquid crystal device comprising:

frequency converting means for converting input display data of a first frame frequency from electronic equipment on a host side into display data of a second frame frequency which is higher than said first frame frequency;

skipping method level control means, connected to an output side of said frequency converting means, for performing a multi-level display to increase the number of colors available for color display;

a direct matrix type liquid crystal panel; and driving means, connected to an output side of said skipping method level control means, for driving said liquid crystal panel, wherein a first timing signal controlling input timing of the display data of said first frame frequency is asynchronous with a second timing signal controlling input timing of the display data of said second frame frequency, and wherein said second timing signal has a frequency which is a non-integral multiple of the frequency of said first timing signal.

* * * * *